US005171097A

United States Patent [19]

Nagaoka et al.

[11] Patent Number: 5,171,097

[45] Date of Patent: Dec. 15, 1992

[54] MECHANICAL PENCIL WITH LEAD-FEEDING DEVICE OPERABLE BY FORWARD SHAKE

[75] Inventors: Toshimasa Nagaoka, Odawara; Kiyoshi Umeda, Edogawa, both of Japan

[73] Assignee: Pilot Precision Kabushiki Kaisha, Kanagawa, Japan

[21] Appl. No.: 885,814

[22] Filed: May 20, 1992

[30] Foreign Application Priority Data

| | | | |
|---|---|---|---|
| May 21, 1991 | [JP] | Japan | 3-45692[U] |
| Feb. 7, 1992 | [JP] | Japan | 4-13088[U] |
| Feb. 28, 1992 | [JP] | Japan | 4-19255[U] |
| Mar. 2, 1992 | [JP] | Japan | 4-19612[U] |

[51] Int. Cl.[5] ..... B43K 21/02; B43K 21/06

[52] U.S. Cl. ..... 401/65; 401/94; 401/115

[58] Field of Search ..... 401/65, 92, 93, 94, 401/115, 67

[56] References Cited

U.S. PATENT DOCUMENTS

| | | | |
|---|---|---|---|
| 271,439 | 1/1883 | Exbel | 401/67 |
| 4,205,924 | 6/1980 | Sumita | 401/65 |
| 4,929,107 | 5/1990 | Kageyama et al. | 401/115 X |

FOREIGN PATENT DOCUMENTS

| | | | |
|---|---|---|---|
| 48652 | 11/1888 | Fed. Rep. of Germany | 401/94 |
| 802797 | 7/1949 | Fed. Rep. of Germany | 401/65 |
| 432406 | 3/1948 | Italy | 401/67 |

*Primary Examiner*—Steven A. Bratlie

*Attorney, Agent, or Firm*—Wenderoth, Lind & Ponack

[57] ABSTRACT

In a mechanical pencil, a tubular lead reservoir is connected to the rearward end of a lead chuck. A cylindrical weight is fitted slidably around the lead reservoir and is adapted to strike against the chuck to open the same to allow forward feed of the lead when a forward shake is applied to the pen barrel. In order to prevent forward feed of the lead as a result of unintended forward shake while carrying the pencil, a slider disposed rearwardly of the lead reservoir has a radially outwardly extending engagement projection which is adapted to slidably engage either a longitudinal guide slot in the pen barrel or a lateral slot circumferentially and rearwardly extending in the pen barrel. When the engagement projection is in engagement with the lateral slot, the chuck is caused to take an advanced position in which the chuck is open so that a forward stroke cannot feed the lead forward.

9 Claims, 4 Drawing Sheets

MECHANICAL PENCIL WITH LEAD-FEEDING DEVICE OPERABLE BY FORWARD SHAKE

BACKGROUND OF THE INVENTION

The present invention relates to mechanical pencils and more particularly to a mechanical pencil of the type having a lead-feeding device operable by forward shake of the pencil to feed or project a pencil lead by a specific distance out through the writing end of the pencil.

The mechanical pencils of the above stated type are disclosed in U.S. Pat. No. 4,205,924 to Sumita and comprise a pen barrel, a lead gripping chuck provided within the pen barrel adjacent to the forward end thereof, a lead reservoir fixed to the rear end of the chuck for storing leads to be fed into the chuck, and a weight provided in the pen barrel so as to be movable forwardly and rearwardly along the lead reservoir. The weight is adapted to impart its inertia force to the chuck, upon being given a forward shake, to feed the chuck and the lead forward. A slider is disposed in the rear end of the pen barrel for forward and rearward shifting movement relative to the pen barrel. The slider is adapted to impart a forward stroke to the lead reservoir and hence the chuck. A knob is provided on the slider.

In the mechanical pencils of the above stated character, whenever the weight within the pen barrel is subjected to a forward shake, the weight causes the lead held by the chuck to be fed forward so as to project out through the writing end of the pencil barrel. Such forward shake occurs when the pencil is being carried by the owner of the pencil. As a results, the lead is unintendedly fed out of the writing end of the pencil while being carried by the owner.

In order to prevent such a phenomenon from occuring, a mechanism for preventing feeding-out of the lead was proposed. The mechanism comprises an operating member projecting through an engaging slot formed in the pen barrel. The operating member is capable of being locked or unlocked relative to the pen barrel. When the operating member is locked with respect to the pen barrel, the lead gripping chuck is prevented from advancing forward so that the lead will not be fed forward.

With the mechanism described above, it is troublesome to manipulate the operating member for locking and unlocking it relative to the pen barrel. Furthermore, the mechanism has a complicated construction for preventing forward movement of the chuck when the operating member is locked relative to the pen barrel. The mechanism has further various practical problems to be solved.

SUMMARY OF THE INVENTION

It is an object of the present invention to solve the above stated problems and to provide a mechanical pencil wherein the lead is reliably prevented from being fed out while the pencil is being carried and wherein the operation for preventing feeding out of the lead can be made easily.

According to the present invention, there is provided a mechanical pencil with a lead-feeding device operable by forward shake of the pencil, comprising a pen barrel with a forward end for writing and a rear end, a lead gripping chuck provided within the pen barrel adjacent to the forward end, a lead reservoir fixed to a rear end of the chuck for storing leads to be fed into the chuck, a weight provided in the pen barrel so as to be movable forwardly and rearwardly along the lead reservoir, the weight being adapted to impart its inertia force to the chuck, upon being given a forward shake, to feed the chuck and the lead forward, a slider disposed in said rear end of the pen barrel for forward and rearward shifting movement relative to the pen barrel, said slider being adapted to impart a forward stroke to said lead reservoir and hence the chuck, a knob on said slider, and engaging means for releasably locking said lead reservoir and the chuck relative to said pen barrel in an advanced position in which the chuck is maintained open, said engaging means comprising a guide slot formed in the pen barrel longitudinally thereof, a lateral slot formed in the pen barrel and extending from a forward end of the guide slot circumferentially and rearwardly of the pen barrel, an engagement projection on said slider and slidably engaging in either said guide slot or said lateral slot, selectively, and return spring acting on said slider to urge the slider rearwardly of the pen barrel to a retracted position in which the slider has an abutting end in rearwardly spaced relation from a rear end of the lead reservoir.

Characteristic features of the mechanical pencil according to the present invention will be clearly understood from the following description which refers to the accompanying drawings.

DESCRIPTION OF THE PREFERRED EMBODIMENTS

Figure 1:
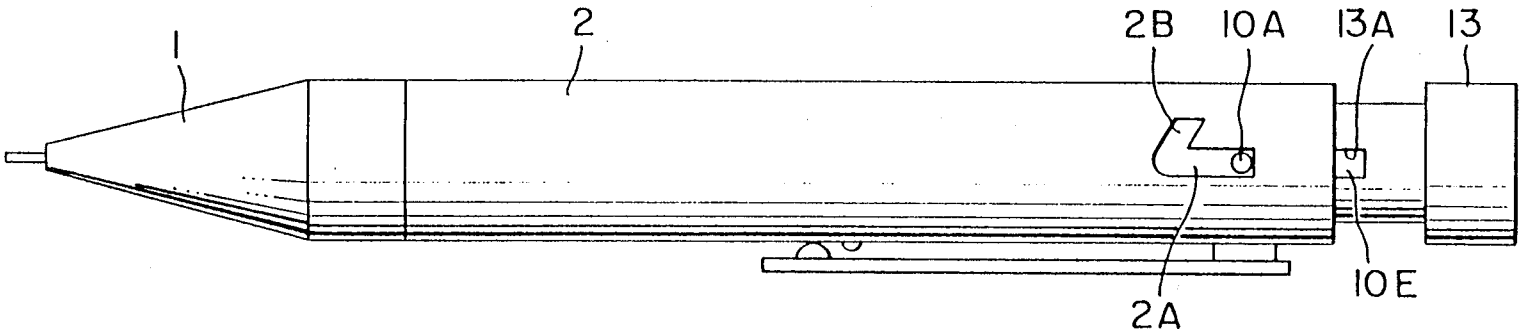
FIG. 1 is an elevational view of a mechanical pencil according to the present invention.
Figure 2:
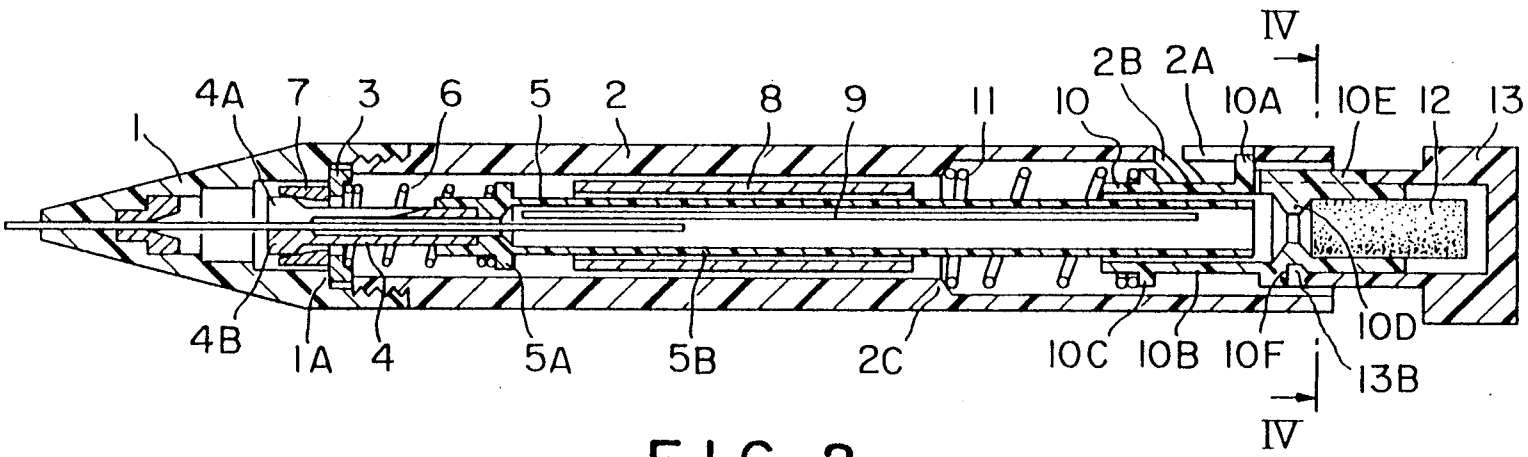
FIG. 2 is a longitudinal section of the mechanical pencil shown in FIG. 1.

Referring now to FIG. 1, the mechanical pencil of the present invention has a pen barrel 2 with a forward conical member 1 which is detachably connected to the barrel 2 as by screw engagement. As shown in FIG. 2, an annular washer 3 is fixedly disposed between an annular shoulder 1A of the conical member 1 and the forward end of the pen barrel 2. A cylindrical lead reservoir 5 is provided within the pen barrel 2. The reservoir 5 has a forward annular step 5A, and a compression coil spring 6 is interposed between the washer 3 and the annular step 5A to resiliently urge the lead reservoir 5 rearward of the pen barrel 2.

Figure 3:
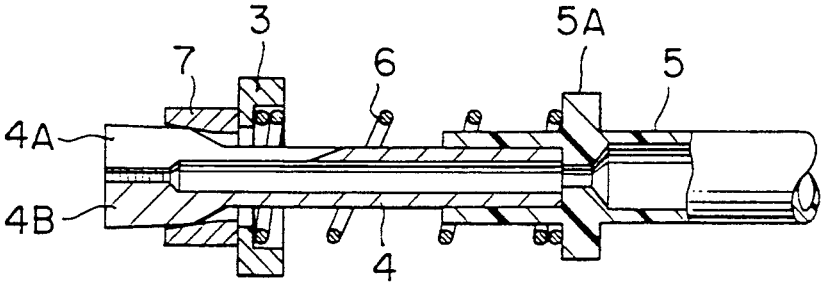
FIG. 3 is a view, on an enlarged scale, showing a part of FIG. 2.

A lead gripping chuck 4 of resilient material is fixedly fitted at its rear end in a cylindrical recess formed in the forward end of the lead reservoir 5. The chuck 4 is therefore urged rearward by the force of the compression spring 6. The chuck 4 has a forward enlarged head 4B. As shown on an enlarged scale in FIG. 3, the chuck 4 has a longitudinal slit 4A. A tightening ring 7 is disposed around the chuck 4 and forwardly of the washer 3. The tightening ring 7 has an inner tapered surface as shown. Due to the rearward force exerted by the spring 6, the forward head 4B of the chuck 4 is urged against the tightening ring 7 and is forced radially inwardly by means of the ring 7 to grip the lead 9. At this time the ring 7 is caused to abut against the washer 3.

A cylindrical weight 8 is fitted around a cylindrical part 5B of the lead reservoir 5 so as to be slidable relative to the cylindrical part 5B. As shown, leads 9 are stored in the lead reservoir 5.

At a rear part of the pen barrel 2 is formed a guide slot 2A extending longitudinally of the barrel, as shown in FIG. 1. A lateral engagement slot 2B extends from the forward end of the guide slot 2A circumferentially and rearwardly of the barrel 2. An engagement projection 10A of circular cross section, for example, is slidably fitted normally in the guide slot 2A. As shown in FIG. 2, the projection 10A is formed on a slider 10 which is generally a cylindrical member and fitted slidably in the rear part of the barrel 2. The slider 10 is therefore slidable longitudinally of the barrel 2 under the guidance of the guide slot 2A. The projection 10A is formed integrally on the rear end of a resilient cantilever 10B extending rearwardly from the slider 10 so that the projection 10A can be displaced radially inwardly out of engagement with the slot 2A, accompanied by radially inward elastic deformation of the cantilever 10B.

In normal writing condition, the engagement projection 10A is urged against the rear end of the slot 2A by means of a return spring 11 which is loaded between an annular inner shoulder 2C of the barrel 2 and an annular outer flange 10C of the slider 10. The slider 10 has an annular inner flange 10D which is normally disposed at a position spaced rearward from the rear end of the lead reservoir 5, as shown.

A cylindrical eraser rubber 12 is detachably fitted in a rear cylindrical recess of the slider 10. The slider 10 has a longitudinally extending outer raised part 10E of bar shape at a rear part thereof which is exposed to the outside at the rear of the rear end of the barrel 2. A circumferentially extending groove 10F is formed so as to be joined to the raised part 10E. A hollow cylindrical knob 13 is detachably fitted to the rear end of the slider 10. The knob 13 has a longitudinally extending elongated open slot 13A (FIG. 1) at its forward end. The slot 13A slidably fits on the raised part 10E on the slider 10. The forward end of the knob 13 has a radially inwardly projecting portion 13B shown in FIG. 2, which portion 13B snappingly engages the circumferential groove 10F. As a result, the knob 13 is attached to the slider 10 in a manner circumferentially immovable relative to the slider 10.

Figure 4:
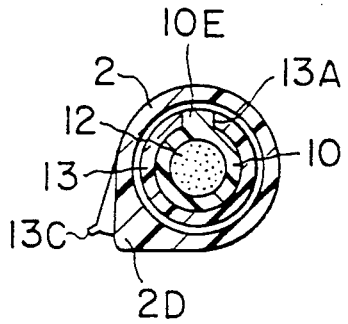
FIG. 4 is a cross section taken along the line IV—IV in FIG. 2.
Figure 5:
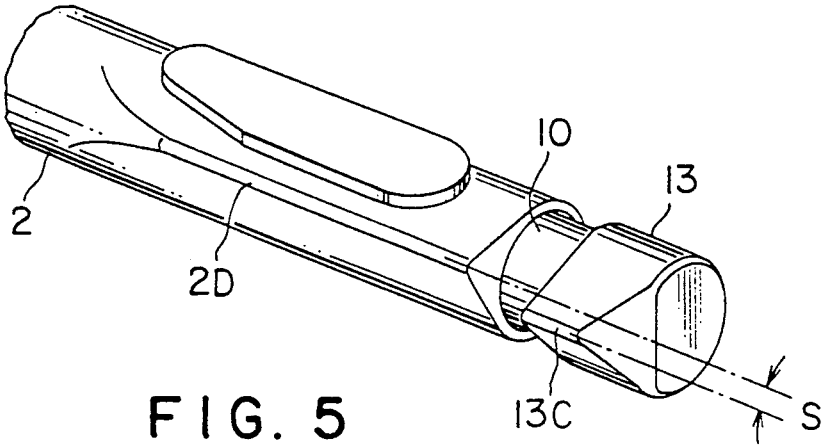
FIG. 5 is a perspective view of a rear portion of the mechanical pencil shown in FIG. 1.

As shown in FIGS. 4 and 5, the knob 13 has a longitudinal rib 13C or other marking while the pen barrel 2 has a longitudinal rib 2D or other marking.

In normal writing state of the mechanical pencil, the lead 9 can be advanced or fed forward by holding and shaking forward the pen barrel 2. That is, by shaking the pen barrel forward, the weight 8 is advanced by inertia force against an annular outer flange 5A of the lead reservoir 5, thereby moving the reservoir 5 and the chuck 4 forward whereby the lead 9 is fed forward. When a lead 9 is used up and a new lead must be supplied into the chuck 4, the knob 13 is knocked by the thumb to advance the slider 10 relative to the barrel 2. Then the projection 10A is advanced in and along the guide slot 2A while the inner flange 10D of the slider 10 also advances and abuts against the rear end of the lead reservoir 5, whereby the reservoir 5 and the chuck 4 are moved forward to cause a new lead to follow as in the conventional mechanical pencil.

When carrying the mechanical pencil in a pocket, for example, the knob 13 is pushed forward by the thumb to cause the lead reservoir 5 to advance so that the chuck 4 is opened. Then the knob 13 is turned when the projection 10A abuts against the forward end of the guide slot 2A, whereby the projection 10A is engaged in the lateral slot 2B. When the knob 13 is released, the projection 10A is caused to move rearward along the lateral slot 2B by the force of the return spring 11 and takes the position shown in FIG. 6. The pen is now in the state shown in FIG. 7.

Figure 6:
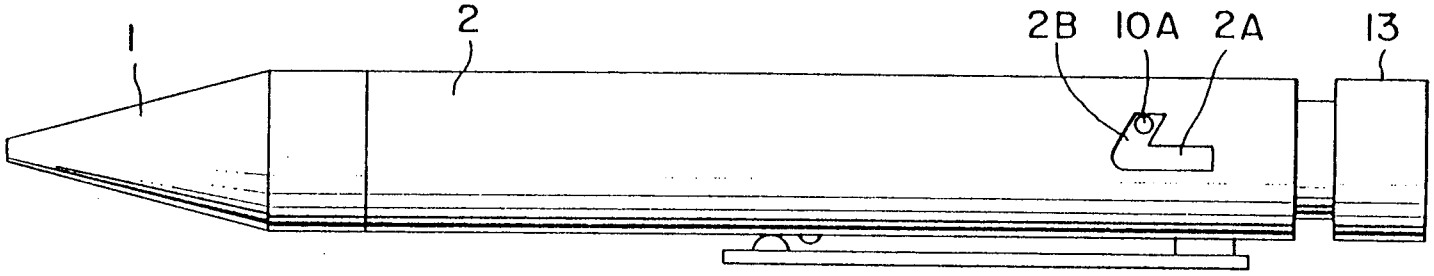
FIG. 6 is a view similar to FIG. 1, showing a different operational state.
Figure 8:
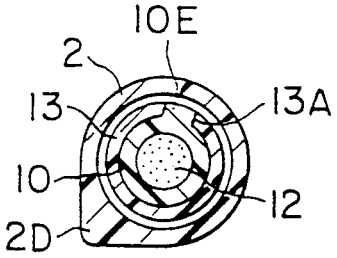
FIG. 8 is a cross section taken along the line VIII—VIII in FIG. 7.

When the projection 10A is in the position shown in FIG. 6, the ribs or markings 13C and 2D shown in FIG. 5 are aligned longitudinally of the pen as shown in FIG. 8, while when the projection 10A is in the guide slot 2A as indicated in FIG. 1, the ribs 13C and 2D are angularly offset as indicated by S in FIG. 5. It will be understood that the ribs 13C and 2D may be replaced by any other markings or indexes showing specific angular positions on the knob 13 and the barrel 2.

Figure 7:
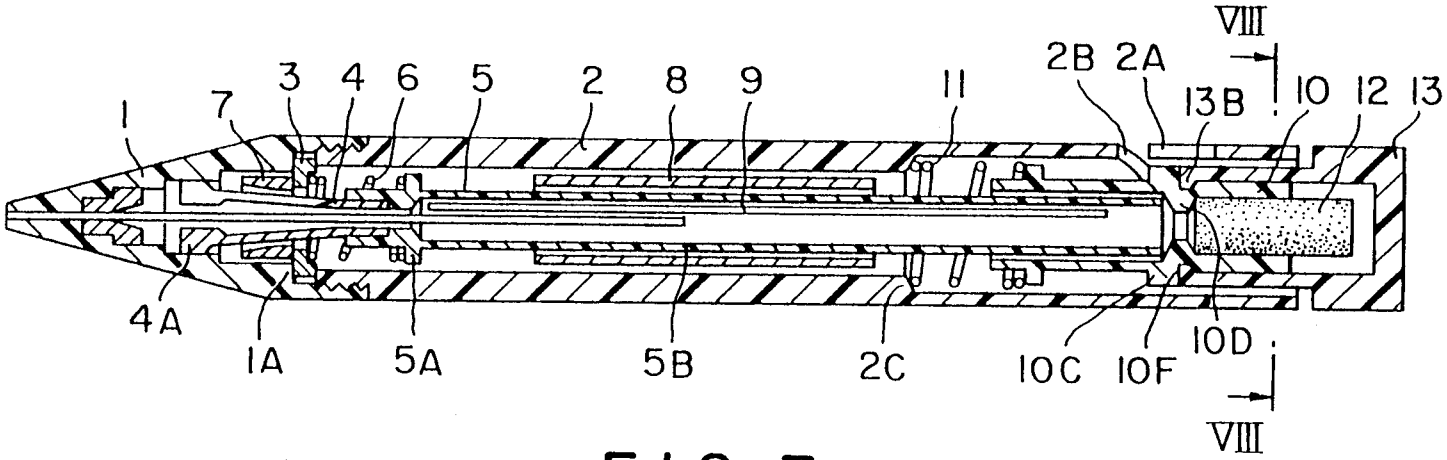
FIG. 7 is a view similar to FIG. 2, showing a different operational state.

In the carrying state shown in FIGS. 6 and 7, the lead 9 will never be fed forward even if the pen is subjected to vibration or shaking action so that the weight 8 is moved forward with inertia force, because the chuck 4 is maintained open. The state for preventing the lead from being fed forward can be confirmed by alignment of the rib 13C of the knob 13 and the rib 2D of the barrel 2.

In order to return the pen from the state of FIG. 6 to the writing state of FIG. 1, it is only necessary to depress the knob 13. Upon depressing the knob 13, the projection 10A advances along the lateral slot 2B and is disengaged therefrom into the guide slot 2A to return rearward therealong to the position of FIG. 1, by the force of the return spring 11.

Figure 9:
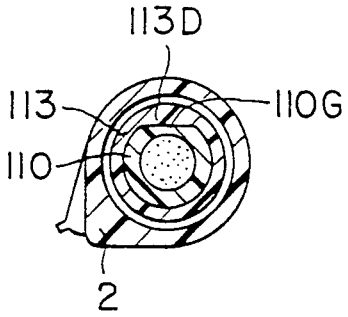
FIG. 9 is a cross-sectional view similar to FIG. 4, showing a modification.

FIG. 9 shows anthoer embodiment of the invention, having a modified structure for mounting the knob. As shown, a generally cylindrical slider 110 equivalent to the slider 10 is formed with a longitudinally extending flat portion 110G which is located on a rear portion of the slider 110, projecting beyond the rear end of the barrel. A circumferential groove extends from the flat portion 110G. A knob 113 equivalent to the knob 13 is formed with an internal raised portion 113D and a circumferentially extending rib which engages the circumferential groove of the slider 110. The raised portion 113D is in face-to-face engagement with the flat portion 110G. Thus the knob 113 is mounted on the slider 110 in a manner immovable circumferentially relative to the slider 110.

Figure 10:
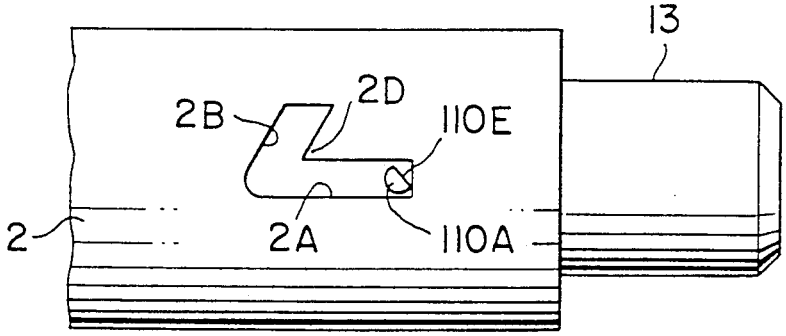
FIG. 10 is a fragmentary elevation of a rear portion of the mechanical pencil, showing a modification.

In a modification shown in FIG. 10 the engagement projection 110A of the slider has a cutout surface 110E which faces an edge 2D defined between the longitudinal and lateral slots 2A and 2B when the projection 110A is in the region in which the slots 2A and 2B are joined. The cutout surface 110E may be a planer surface or a convex curved surface.

According to this modification, when the projection 110A is disengaged from the lateral slot 2B, the projection is allowed to smoothly move into the guide slot 2A without being obstructed by the edge 2D of acute angle because the cutout surface 110E prevents interference between the projection 110A and the edge 2D.

Figure 11:
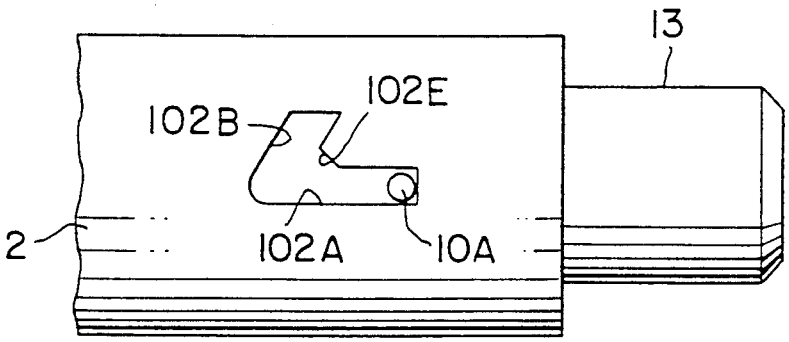
FIG. 11 is a fragmentary elevation of a rear portion of the mechanical pencil, showing a further modification.

A further modification is shown in FIG. 11 in which the engagement projection 10A has a circular cross section as in the embodiment of FIGS. 1 through 8 and in which the edge formed between the guide and lateral slots 102A and 102B is chamferred at 102E as shown. It will be understood that the chamferred surface 102E of the edge allows the engagement projection 10A to pass smoothly thereover from within the lateral slot 102B into the guide slot 102A.

While preferred embodiments of the present invention have been described so far, it is to be understood that this disclosure is for the purpose of illustration and that various changes and modifications may be made without departing from the scope of the invention as set forth in the appended claims.

What is claimed is:

1. A mechanical pencil with a lead-feeding device operable by forward shake of the pencil, comprising:

a pen barrel with a forward end for writing and a rear end;

a lead gripping chuck provided within the pen barrel adjacent to said forward end;

a lead reservoir fixed to a rear end of said chuck for storing leads to be fed into the chuck;

a weight provided in the pen barrel so as to be movable forwardly and rearwardly along said lead reservoir, said weight being adapted to impart its inertia force to said chuck, upon being given a forward shake, to feed the chuck and the lead forward;

a slider disposed in said rear end of the pen barrel for forward and rearward shifting movement relative to the pen barrel, said slider being adapted to impart a forward stroke to said lead reservoir and hence the chuck;

a knob on said slider; and engaging means for releasably locking said lead reservoir and the chuck relative to said pen barrel in an advanced position in which the chuck is maintained open, said engaging means comprising:

a guide slot formed in the pen barrel longitudinally thereof;

a lateral slot formed in the pen barrel and extending from a forward end of the guide slot circumferentially and rearwardly of the pen barrel;

an engagement projection on said slider and slidably engaging in either said guide slot or said lateral slot, selectively; and return spring acting on said slider to urge the slider rearwardly of the pen barrel to a retracted position in which the slider has an abutting end in rearwardly spaced relation from a rear end of the lead reservoir.

2. The mechanical pencil according to claim 1, wherein said guide slot and lateral slot form an edge of acute angle therebetween.

3. The mechanical pencil according to claim 2, wherein said edge is chamferred.

4. The mechanical pencil according to claim 1, wherein said engagement projection is of circular cross section.

5. The mechanical pencil according to claim 2, wherein said engagement projection has a cutout surface facing said edge when the engagement projection is in a region where the guide slot and the lateral slot are joined to each other.

6. The mechanical pencil according to claim 1, wherein said engagement projection is provided on a rear free end of a resilient cantilever extending rearwardly from the slider.

7. The mechanical pencil according to claim 1, wherein said knob is fitted on the slider in a manner circumferentially immovable relative to the slider.

8. The mechanical pencil according to claim 7, wherein said knob has a first marking thereon and said pen barrel has a second marking thereon, the first and second markings being aligned longitudinally, when the engagement projection is in said lateral slot, and being offset from each other when the engagement projection is in said guide slot.

9. The mechanical pencil according to claim 8, wherein said markings are longitudinal ridges formed on the knob and the pen barrel.

* * * * *